United States Patent [19]

Van Grinsven et al.

[11] 4,318,802

[45] Mar. 9, 1982

[54] PROCESS FOR THE PURIFICATION OF HYDROCARBONS

[75] Inventors: Petrus F. A. Van Grinsven; Martin F. M. Post, both of Amsterdam, Netherlands

[73] Assignee: Shell Oil Company, Houston, Tex.

[21] Appl. No.: 200,175

[22] Filed: Oct. 24, 1980

[30] Foreign Application Priority Data

Nov. 21, 1979 [NL] Netherlands ..... 7908477

[51] Int. Cl.[3] ..... C10G 25/05

[52] U.S. Cl. ..... 208/245; 208/250; 208/307

[58] Field of Search ..... 208/245

[56] References Cited

U.S. PATENT DOCUMENTS

| | | | |
|---|---|---|---|
| 3,098,814 | 7/1963 | Epperly | 208/245 |
| 3,188,293 | 6/1965 | Bacon et al. | 208/245 |
| 3,211,644 | 10/1965 | Clark | 208/245 |
| 3,620,969 | 11/1971 | Turnock et al. | 208/245 |
| 4,208,305 | 6/1980 | Kouwenhoven et al. | 252/455 Z |

*Primary Examiner*—Delbert E. Gantz

*Assistant Examiner*—O. Chaudhuri

[57] ABSTRACT

A process is disclosed for removal of mercaptans from mercaptan-containing low boiling hydrocarbon mixture wherein said mixtures are fed to a contact zone containing a crystalline metal silicate which in dehydrated form has a composition in terms of moles of the oxides:

$$(1.0\pm0.3)(R)_{2/n}0.[aFe_2O_3.bAl_2O_3.cGa_2O_3.y(dSiO_2.eGeO_2)],$$

where R is one or more mono- or bivalent cations and a, b, c, d, e, y and n are defined as hereinafter disclosed. The disclosed silicate crystalline metal silicate is (a) thermally stable up to a temperature above 600° C.; (b) exhibits a specified X-ray powder diffraction pattern showing the reflections set out in Table A of the specification; (c) in the formula which represents the composition of the silicate expressed in terms of moles of the oxides, the $(Al_2O_3+Fe_2O_3)/SiO_2$ molar ratio is lower than 0.1; and separating from said crystalline silicate a hydrocarbon mixture product having a lower mercaptan content than the feed.

10 Claims, No Drawings

PROCESS FOR THE PURIFICATION OF HYDROCARBONS

BACKGROUND OF THE INVENTION

The invention relates to a process for the removal of mercaptans from light hydrocarbon mixtures.

As a rule, gasolines originating from sulfur-containing petroleum contain a considerable amount of mercaptans. This holds both for gasolines obtained by atmospheric distillation of crude mineral oil and for gasolines obtained by conversion of heavy hydrocarbon oils, such as catalytic cracking, thermal cracking and hydrocracking. The presence of mercaptans in gasolines is undesirable, since they are responsible for an unpleasant odor of the gasolines and since in the combustion of the gasolines the sulphur present in the mercaptans finds its way into the atmosphere as oxides, such as e.g. sulphur dioxide. If the aim is to upgrade the gasoline by subjecting it to catalytic reforming, the sulphur present in the mercaptans is a serious drawback in connection with the poisoning of the reforming catalyst which typically contains at least one noble metal. It has already been proposed in the past to subject gasolines containing mercaptans to a chemical treatment which results in the conversion of the mercaptans into disulphides, which disulphides, like mercaptans, are soluble in the gasolines. Such a gasoline treatment only partially, solves the problem since, although the unpleasant odor of the gasoline is removed, the sulphur remains in the gasolines. Both in gasoline combustion and when gasolines are used as the feed for a catalytic reforming unit, the above-mentioned problems will be undiminished, since they are caused by the presence of sulphur in the gasolines and not by the type of compound in which the sulphur is present. For the last-mentioned problems a solution can only be found by removing the sulphur present in the mercaptans from the gasolines. This may be effected by subjecting the gasolines to a high-pressure catalytic hydrotreatment, in which sulphur is removed from the mercaptans in the gasolines in the form of hydrogen sulphide. Although such hydrotreatment can achieve an almost complete removal of the sulphur present in the mercaptans in the gasolines, this treatment has nevertheless a serious drawback. As is the case with all the high-pressure catalytic hydrotreatments, the present mercaptan removal is a costly process.

It will be clear from the above that for the removal of mercaptans from gasolines there is an urgent need for a process which, with respect to the attainable sulphur content in the product, gives results that are comparable with those of the high-pressure catalytic hydrotreatment, without being attended with the high costs of the latter treatment. Since, as a rule, also in liquefied petroleum gases a considerable amount of mercaptans is present, it would be desirable if the said process could also be used for removing mercaptans from this fuel, in view of air pollution by sulphur dioxide when using this fuel.

Applicants have carried out an investigation to find out whether the above-mentioned requirement can be satisfied by using a solid adsorbent. Since it is customary in the removal of small amounts of organic contaminants from product streams to regenerate the adsorbent loaded with contaminants by means of a treatment with an oxygen-containing gas at a temperature higher than 400° C., the adsorbent concerned should additionally have a sufficient thermal stability.

In connection with this additional requirement the investigation was restricted to inorganic materials. Both amorphous and crystalline materials were used in the investigation. Amorphous alumina and amorphous silica as well as the crystalline aluminum silicates 5A, 13X and ferrierite were found to be unsuitable for the present purpose. These materials do have a sufficiently high thermal stability to make them eligible for use, but their adsorption capacity for mercaptans is too low.

Surprisingly, it has been found that certain crystalline metal silicates, a number of which have recently been synthesized, as described e.g. in U.S. Pat. No. 4,208,305 incorporated by reference, are excellently suited for use as adsorbent for the removal of mercaptans from light hydrocarbon mixtures.

The said crystalline metal silicates have not only a sufficiently high thermal stability to enable them to be regenerated without problems with the aid of a high-temperature treatment, but also a very high adsorption capacity for mercaptans. By using the said crystalline metal silicates as adsorbents, products can be prepared with a sulphur content corresponding with that obtained when using a high-pressure catalytic hydrotreatment. The said crystalline metal silicates are not only very suitable for removing mercaptans from hydrocarbon mixtures boiling in the gasoline range, but also for the removal of mercaptans from liquefied petroleum gases.

The present patent application therefore relates to a process for the removal of mercaptans from light hydrocarbon mixtures, the light hydrocarbon mixtures being contacted with certain crystalline metal silicate as hereinafter defined.

SUMMARY OF THE INVENTION

Accordingly the invention provides a process for the removal of mercaptans from light hydrocarbon mixtures, which comprises contacting mercaptan-containing light hydrocarbon mixture as feed in a contact zone with a crystalline metal silicate, which silicate has the following properties:

(a) thermally stable up to a temperature above 600° C., (b) an X-ray powder diffraction pattern showing, inter alia, the reflections given in Table A, in the specification (hereinafter) and separating from said crystalline silicate a hydrocarbon mixture product having lower mercaptan content than said feed.

DESCRIPTION OF THE PREFERRED EMBODIMENTS

In this patent application the term light hydrocarbons refers to hydrocarbons boiling at atmospheric pressure in the range from about −45° C. to 200° C. and includes at least one of Liquified Petroleum gases and gasolines. The term gasolines herein denote hydrocarbon mixtures with an initial boiling point higher than 35° C. and a final boiling point lower than 200° C.

The lowest content of mercaptans in light hydrocarbon mixtures at which it is still worth while to use the process according to the invention is substantially determined by the intended use of the purified hydrocarbon mixtures. Thus, when mercaptans are present in gasolines which, after purification, are to be used as the feed for a catalytic reforming operation, the process according to the invention may still be applied to gasolines with only a very low content of mercaptans, in contrast with a situation where mercaptans are present in light hydrocarbon mixtures which, after purification, are to be used as fuel. The highest content of mercaptans at which it is still worth while to use the process according to the invention is substantially determined by economic considerations, such as the amount of hydrocarbon mixture which can be purified with a certain amount of adsorbent before the adsorbent will have to be regenerated. As a rule, the process according to the invention will not be applied to hydrocarbon mixtures containing less than 5 or more than 1000 ppmw mercaptans. The process is pre-eminently applicable to hydrocarbon mixtures containing 10–500 ppmw mercaptans.

The process according to the invention may be used both for the removal of mercaptans from liquid hydrocarbon mixtures and for the removal of such compounds from gaseous hydrocarbon mixtures.

The purification of light hydrocarbon mixtures according to the invention may be carried out by contacting the hydrocarbon mixtures with the crystalline metal silicate which is present either in the form of a fixed bed or in fluidised form. In the regeneration of the crystalline metal silicate, which is preferably effected by contacting the metal silicate at a temperature about 400° C. with an oxygen-containing gas, the metal silicate may also be present in the form of a fixed bed or in fluidised form. In the process according to the invention distinct preference is given for both the adsorption and the regeneration, to a crystalline metal silicate that is present in the form of a fixed bed.

If the light hydrocarbon mixture that is purified according to the invention contains, in addition to mercaptans, other organic sulphur compounds, the latter will as a rule at least partly be adsorbed together with the mercaptans by the crystalline metal silicate.

The crystalline silicates employed in the process of the invention are characterized in having the following properties:

(a) thermally stable up to a temperature above 600° C., (b) an X-ray powder diffraction pattern showing, inter alia, the reflections given in Table A.

TABLE A

| Radiation: Cu—K 2 θ | Wavelength 0.15418 nm relative intensity |
|---|---|
| 7.8–8.2 | S |
| 8.7–9.1 | M |
| 11.8–12.1 | W |
| 12.4–12.7 | W |
| 14.6–14.9 | W |
| 15.4–15.7 | W |
| 15.8–16.1 | W |
| 17.6–17.9 | W |
| 19.2–19.5 | W |
| 20.2–20.6 | W |
| 20.7–21.1 | W |
| 23.1–23.4 | VS |
| 23.8–24.1 | VS |
| 24.2–24.8 | S |
| 29.7–30.1 | M |

wherein the letters have the following meanings: VS=very strong; S=strong; M=moderate; W=weak; θ=angle according to Bragg.

(c) in the formula which represents the composition of the silicate, expressed in moles of the oxides, and in which oxides of hydrogen, alkali metal and/or alkaline-earth metal, silicon, aluminum and/or iron are present, the $(Al_2O_3+Fe_2O_3)/SiO_2$ molar ratio (for the sake of brevity further designated as m in this patent application) is lower than 0.1.

According to the invention the crystalline metal silicates used have an m-value less than 0.1. Preferred metal silicates are those of which the m-value is more than 0.002 and particularly more than 0.01. Depending on whether in the base mixture from which the crystalline metal silicates are prepared as trivalent metal compounds either exclusively one or more aluminum compounds, or exclusively one or more iron compounds, or both one or more aluminum compounds and one or more iron compounds are incorporated, crystalline metal silicates are obtained, which are designated as aluminum silicates, iron silicates and aluminum/iron silicates, respectively. In the process according to the invention each of these three groups of crystalline metal silicates may be used. In respect of the crystalline metal silicates which have been prepared from a base mixture in which as trivalent metal compounds exclusively one or more iron compounds have been incorporated, the following has to be observed. Although the crystalline metal silicates thus obtained are designated as iron silicates, they may contain, in addition to iron, a small amount of aluminum. The silicon compounds which are suitable from an economic point of view for the preparation of crystalline silicates on a technical scale, contain as a rule a small amount of aluminum as a contaminant. Generally, the aluminum is found, at least partly, in the silicate prepared.

The metal silicates used in the process according to the invention have been defined, inter alia, with reference to the X-ray powder diffraction pattern. This pattern should contain, inter alia, the reflections shown in Table A. The complete X-ray powder diffraction pattern of a typical example of a silicate suitable for use according to the invention is shown in Table B (Radiation: Cu-K; wavelength: 0.15418 nm).

TABLE B

| 2 θ | relative intensity ($100.I/I_o$) | description |
|---|---|---|
| 8.00 | 55 | SP |
| 8.90 | 36 | SP |
| 9.10 | 20 | SR |
| 11.95 | 7 | NL |
| 12.55 | 3 | NL |
| 13.25 | 4 | NL |
| 13.95 | 10 | NL |
| 14.75 | 9 | BD |
| 15.55 | 7 | BD |
| 15.95 | 9 | BD |
| 17.75 | 5 | BD |
| 19.35 | 6 | NL |
| 20.40 | 9 | NL |
| 20.90 | 10 | NL |
| 21.80 | 4 | NL |
| 22.25 | 8 | NL |
| 23.25 | $100^{(x)}$ | SP |
| 23.95 | 45 | SP |
| 24.40 | 27 | SP |
| 25.90 | 11 | BD |
| 26.70 | 9 | BD |
| 27.50 | 4 | NL |
| 29.30 | 7 | NL |
| 29.90 | 11 | BD |
| 31.25 | 2 | NL |
| 32.75 | 4 | NL |
| 34.40 | 4 | NL |
| 36.05 | 5 | BD |
| 37.50 | 4 | BD |
| 45.30 | 9 | BD |

$^{(x)}I_o$ = intensity of the strongest separate reflection present in the pattern.

The letters used in Table B for describing the reflections have the following meanings: SP=sharp; SR=shoulder; NL=normal; BD=broad; $\theta$=angle according to Bragg.

The crystalline metal silicates used as adsorbent in the process according to the invention may be prepared from an aqueous mixture containing the following compounds: one or more compounds of an alkali metal and/or alkaline-earth metal (M), one or more compounds containing an organic cation (R) or from which such a cation is formed during the preparation of the silicate, one or more silicon compounds and one or more aluminum and/or iron compounds. The preparation is performed by maintaining the mixture at elevated temperature until the silicate has been formed and subsequently separating the crystals of the silicate from the mother liquor and calcining them. In the aqueous mixture from which the silicates are prepared the various compounds should be present in the following ratios, expressed in moles of the oxides:

$M_{2/n}O$: $R_2O=0.1-20$, $R_2O$: $SiO_2=0.01-0.5$, $SiO_2$: $(Al_2O_3+Fe_2O_3)>10$, $H_2O$: $SiO_2=5-50$; (n is the valency of M).

In the preparation of the silicates it is preferred to start from a base mixture in which M is present in an alkali metal compound and R in a tetraalkylammonium compound, and particularly from a base mixture in which M is present in a sodium compound and R in a tetrapropylammonium compound.

If in the above preparation procedure the starting material is an aqueous mixture in which no aluminum or iron compound has been incorporated, a crystalline silicate having the properties mentioned above under (a) and (b) is nevertheless obtained. Surprisingly, it has been found that, as distinct from the closely related crystalline metal silicates which had been used in the process according to the invention, these crystalline silicates are unsuitable for the removal of mercaptans from light hydrocarbon mixtures.

The crystalline metal silicates prepared in the above way contain hydrogen ions and alkali metal and/or alkaline-earth metal ions. In the process according to the invention it is preferred to use a crystalline metal silicate in which the hydrogen ions have been replaced substantially by other cations, particularly alkali metal and/or alkaline-earth metal ions. The conversion of the silicates into the alkali metal and/or alkaline-earth metal form can conveniently be effected by treating the silicates once or several times with an aqueous solution of an alkali metal salt and/or an alkaline-earth metal salt followed by calcining.

The invention will now be explained with reference to the following example.

EXAMPLE

Four crystalline silicates (silicates 1–4) were prepared by heating aqueous mixtures containing $SiO_2$, NaOH and $(C_3H_7)_4NOH$, and, optionally, $NaAlO_2$ and/or $Fe(NO_3)_3$ for 24 hours at 150° C. in an autoclave under autogenous pressure. After the reaction mixtures had cooled down, the silicates formed were filtered off, washed with water until the pH of the wash water was about 8, dried at 120° C. and calcined at 500° C. The silicates 1–4 had the following properties:

(a) thermally stable up to a temperature above 800° C., (b) an X-ray powder diffraction pattern substantially equal to the one given in Table B, (c) a value for m as given in Table C.

TABLE C

| Silicate No. | $Al_2O_3SiO_2$ | $Fe_2O_3/SiO_2$ | m |
|---|---|---|---|
| 1. | — | — | — |
| 2. | 0.033 | — | 0.033 |
| 3. | — | 0.032 | 0.032 |
| 4. | 0.015 | 0.016 | 0.031 |

The molar composition of the aqueous mixtures from which the silicates 1–4 were prepared can be represented as follows:

$$Na_2O.1.5[(C_3H_7)_4N]_2O.xAl_2O_3.yFe_2O_3.25SiO_2.450\text{-}H_2O,$$

wherein x and y have the values given in Table D.

TABLE D

| Silicate No. | x | y |
|---|---|---|
| 1. | — | — |
| 2. | 0.67 | — |
| 3. | — | 0.67 |
| 4. | 0.33 | 0.33 |

From silicate 2 a silicate 5 was prepared by boiling silicate 2 with 1.0 molar $NH_4NO_3$ solution, washing with water, boiling again with 1.0 molar $NH_3NO_3$ solution and washing, drying at 120° C. and calcining at 500° C. From the silicates 2–4 the silicates 6–8 were prepared, respectively, by boiling the silicates 2–4 with 1.0 molar $NaNO_3$ solution, washing with water, drying at 120° C. and calcining at 500° C. The silicates 1 and 5–8 were tested for their suitability for the removal of mercaptans from light hydrocarbon mixtures. The following adsorbents were included in the investigation: an amorphous silica with a surface area of 219 $m^2/g$, an amorphous alumina with a surface area of 164 $m^2/g$, zeolite 5A, zeolite 13X and Na-ferrierite. The testing was effected by mixing 15 g adsorbent with 100 ml isooctane containing 120 ppmw sulphur in the form of 3-methylbutanethiol-2 and shaking the mixture for three hours at 25° C. After each shaking experiment the sulphur content of the isooctane treated was determined. In the experiments 1–4 with amorphous silica, amorphous alumina, zeolite 5A and Na-ferrierite the isooctane treated still contained more than 75 ppmw sulphur. The results of the other experiments are given in Table E.

TABLE E

| Experiment No. | Adsorbent | Sulphur content of the isooctane treated, ppmw |
|---|---|---|
| 5 | Zeolite 13X | 10 |
| 6 | Silicate 1 | 44 |
| 7 | Silicate 5 | 0.9 |
| 8 | Silicate 6 | 0.5 |
| 9 | Silicate 7 | 0.5 |
| 10 | Silicate 8 | 0.5 |

Of the experiments mentioned hereinbefore only those numbered 7–10 are experiments according to the invention. Experiments 1–6 are outside the scope of the invention and have been included for comparison.

What is claimed is:

1. A process for the removal of mercaptans from light hydrocarbon mixtures, which comprises contacting mercaptan-containing hydrocarbon mixture as feed in a contact zone with a crystalline metal silicate, which silicate has the following properties:

(a) thermally stable up to a temperature above 600° C.;

(b) an X-ray powder diffraction pattern showing, inter alia, the reflections given in Table A, in the specification;

(c) an overall composition in the dehydrated form, in terms of moles of the oxides:

$$(1.0\pm0.3)(R)_{2/n}O.[aFe_2O_3.bAl_2O_3.cGa_2O_3].y(dSiO_2.eGeO_2),$$

where

R = one or more monovalent or bivalent cations;

$a \geqq 0.1$;

$b \geqq 0$;

$c \geqq 0$;

$a+b+c=1$;

$y \geqq 10$;

$d \geqq 0.1$;

$e \geqq 0$;

$d+e=1$ and n = the valency of R;

(d) in the formula which represents the composition of the silicate, expressed in moles of the oxides, and in which oxides of hydrogen, alkali metal and/or alkaline earth metal, silicon, aluminum and/or iron are present, the $(Al_2O_3+Fe_2O_3)/SiO_2$ molar ratio, designated herein as m, is lower than 0.1; and (e) separating from said crystalline silicate a hydrocarbon mixture product having lower mercaptan content than said feed.

2. A process according to claim 1, wherein said feed is gasoline.

3. A process according to claim 1, wherein said feed is liquefied petroleum gas.

4. A process according to claim 1, wherein said hydrocarbon mixture feed contains 5–1000 ppmw mercaptans.

5. A process according to claim 4, wherein said hydrocarbon mixture feed contains 10–500 ppmw mercaptans.

6. A process according to claim 1, wherein the value of m of the crystalline metal silicate is more than 0.002.

7. A process according to claim 6, wherein the value of m of the crystalline metal silicate is more than 0.01.

8. A process according to claim 1, comprising the following additional steps:

(a) separating the mercaptan-containing crystalline metal silicate from the hydrocarbon, then (b) contacting said crystalline metal silicate with an oxygen-containing gas at a temperature above 400° C. for a time sufficient to substantially remove the mercaptan from said silicate, whereby said silicate is regenerated.

9. A process according to claim 8 comprising the following additional step:

Contacting the regenerated crystalline silicate from step (b) with additional mercaptan-containing light hydrocarbon mixtures.

10. A process according to claim 1, wherein the crystalline metal silicate is present substantially in the alkali metal and/or alkaline-earth metal form.

* * * * *